US007462114B2

(12) United States Patent
Moller, Jr.

(10) Patent No.: US 7,462,114 B2
(45) Date of Patent: Dec. 9, 2008

(54) REBOUND SYSTEM

(76) Inventor: Jorgen J. Moller, Jr., 3043 E. Brighton Pl., Salt Lake City, UT (US) 84121

( * ) Notice: Subject to any disclaimer, the term of this patent is extended or adjusted under 35 U.S.C. 154(b) by 0 days.

(21) Appl. No.: 11/178,864

(22) Filed: Jul. 11, 2005

(65) Prior Publication Data

US 2007/0010355 A1 Jan. 11, 2007

(51) Int. Cl.
*A63B 67/00* (2006.01)

(52) U.S. Cl. ..... 473/415; 473/421; 473/446; 473/471; 473/476

(58) Field of Classification Search ..... 473/415, 473/197, 421, 422, 446, 465, 469, 471, 478
See application file for complete search history.

(56) References Cited

U.S. PATENT DOCUMENTS 4,669,138 A * 6/1987 Kassai ..... 5/99.1
4,948,129 A * 8/1990 Bartasius ..... 473/415
4,960,284 A * 10/1990 Stude ..... 473/435
5,048,844 A * 9/1991 Haseltine ..... 273/400
5,634,638 A * 6/1997 Havens et al. ..... 473/421
5,967,089 A * 10/1999 Allen ..... 119/474
6,846,253 B1 * 1/2005 Szwalek ..... 473/446
7,001,288 B2 * 2/2006 Harrell ..... 473/446
7,104,901 B1 * 9/2006 Mason ..... 473/446
7,104,902 B2 * 9/2006 Dopson ..... 473/465
2004/0132558 A1 * 7/2004 Rothman ..... 473/434

* cited by examiner

*Primary Examiner*—Mitra Aryanpour
(74) *Attorney, Agent, or Firm*—Holland & Hart

(57) ABSTRACT

The present specification describes sporting equipment methods and apparatus that may be used for ball play, and may be particularly useful for ball rebounding. One aspect of the novel sporting equipment described herein relates to the adjustability of a rebounder. Rebounders or rebound systems in accordance with principles of the present invention are strong, durable, and also adjustable. An adjustment mechanism in accordance with principles of the present invention may permit a user to change the angle of the rebound system to change the trajectory of rebounded balls to suit the needs of various players and situations. In contrast, conventional rebounders tend to be small, flimsy and are not adjustable.

3 Claims, 5 Drawing Sheets

REBOUND SYSTEM

TECHNICAL FIELD

This invention relates to sports systems, including in particular ball rebound systems.

BACKGROUND OF THE INVENTION

Many devices are currently available that support a net for the purpose of returning or restraining a sports game ball. Devices have been developed for footballs, soccer balls and golf balls, and others serve as a pitchback and target for baseballs and softballs. Unfortunately these devices are not without their limitations and shortcomings. Conventional support devices for nets are often cumbersome and unwieldy, and not easy to transport and store efficiently, particularly when they cannot be collapsed or folded for that purpose. Portable devices are particularly flimsy and do not allow users to practice at full effort. Permanent devices have net inclination angles which cannot be adjusted. Therefore, most currently available devices are generally restricted to being used with balls of one particular sport, and do not lend themselves to being used in conjunction with a variety of sports. Therefore, permanent systems continue to be sought and developed.

SUMMARY OF THE INVENTION

The principles described herein may be followed to provide a ball rebounding system that is easy to assemble and simple to adjust to different vertical rebound angles. According to one embodiment of the present invention, a sporting equipment apparatus is disclosed. The sporting equipment apparatus comprises a ball rebounder, the ball rebounder comprising an anchor, a frame assembly adjustably attached to the anchor, and a resilient fabric or net stretched across the frame assembly. The frame assembly may be adjustably attached to the anchor at a plurality of angles. The anchor may comprise first and second anchor poles rigidly mounted in the ground and spaced from one another. The apparatus may further include a first pair of hinges connecting the frame assembly to the anchor and a second pair of sliding hinges connecting the frame assembly to the anchor. Some embodiments may include a first pair of pinned hinges connecting a lower portion of the frame assembly to the anchor and a second pair of sliding hinges connecting an upper portion of the frame assembly to the anchor. The first pair of pinned hinges allows pivoting rotation of the frame with respect to the anchor, and the second pair of sliding hinges limits the angles of pivoting rotation.

According to some embodiments, the sports equipment apparatus further comprises first, second, third, and fourth hinge brackets attached to the anchor; first, second, third, and fourth hinge brackets attached to the frame assembly, a first pin pivotably connecting the first hinge brackets of the anchor and frame assembly, a second pin pivotably connecting the second hinge brackets of the anchor and frame assembly, a first slide connected between the third hinge brackets of the anchor and frame assembly, and a second slide connected between the fourth hinge brackets of the anchor and frame assembly. Each of the first and second slides may comprise a curved plate having a window disposed therein. The first and second slides may be rotatably pinned to the third and fourth hinge brackets of the anchor, respectively, and the third and fourth hinge brackets may be slidingly pinned across the windows of the first and second slides, respectively.

Another aspect of the invention provides a sporting equipment apparatus comprising a ball rebounding system. The ball rebounding system comprises a rigidly mounted anchor, a frame assembly pivotably attached to the anchor, and a net attached to the frame. The frame assembly is movable with respect to the anchor to adjust and lock an angle of the frame assembly with respect to ground or the anchor. The frame assembly pivotably attached to the anchor may comprise a first pinned connection between the frame assembly and the anchor, and a first slide connection between the frame assembly and the anchor. The frame assembly pivotably attached to the anchor may comprise first and second pinned connections between the frame assembly and the anchor, and first and second slide connections between the frame assembly and the anchor. The first slide connection may comprise a plate with a window, and the plate may be rotatably pinned to the anchor with the frame assembly slidably pinned across the window of the plate. The anchor may comprise first and second anchor poles rigidly mounted to the ground.

According to some embodiments, the frame assembly pivotably attached to the anchor comprises first and second pinned connections between the frame assembly and the anchor, and first and second slide connections between the frame assembly and the anchor. The first and second pinned connections allow rotation of the frame assembly relative to the anchor, and the first and second slide connections limit rotation of the frame assembly. The first and second slide connections may lock the frame assembly at an angle relative to ground. A first adjustment handle may lock and release sliding movement of the first slide connection, and a second adjustment handle may lock and release sliding movement of the second slide connection.

Another aspect of the invention provides a ball rebound assembly. The ball rebound assembly comprises a frame assembly, and the frame assembly comprises two frame verticals, two frame horizontals, and four frame corners. The rebound assembly also comprises an anchor assembly having two anchor poles, and a net for attachment to the frame assembly. The rebound assembly includes first hinges for attachment between the frame assembly and the anchor assembly, and second slide hinges for attachment between the frame assembly and the anchor assembly at a spacing from the first hinges. The slide hinges may include adjustment handles. The second slide hinges may comprise offset brackets interconnected to one another by pins attached to a windowed plate.

Another aspect of the invention provides a method of adjusting a ball rebounder. The method comprises pivotably connecting a framed resilient fabric to an anchor, rotating the framed resilient fabric relative to the anchor, and locking the framed resilient fabric relative to the anchor. Rotating the framed resilient fabric may comprise sliding a pin attached to either the framed resilient fabric or the anchor along a windowed plate interconnecting the framed resilient fabric and the anchor. Locking the framed resilient fabric may comprise tightening the pin against the windowed plate. Rotating may also comprise sliding a pin attached to one of the framed resilient fabric or the anchor along a windowed plate interconnecting the framed resilient fabric and the anchor, and locking may comprise turning an adjustment handle to tighten the pin against the windowed plate.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION

The present specification describes sporting equipment methods and apparatus that may be used for ball play, and may be particularly useful for ball rebounding. One aspect of the novel sporting equipment described herein relates to the adjustability of a rebounder. Rebounders or rebound systems in accordance with principles of the present invention are strong, durable, and also adjustable. An adjustment mechanism in accordance with principles of the present invention may permit a user to change the angle of the rebound system to change the trajectory of rebounded balls to suit the needs of various players and situations. In contrast, conventional rebounders tend to be small, flimsy and are not adjustable.

Another aspect of the novel rebounding system relates to its anchoring system. The anchoring system facilitates robust and easy installation of the adjustable rebound frame assembly. A simple anchor or pair of anchors may be installed that are receptive of the frame assembly and other components. Previous permanent rebounders generally require the installation of the rebound frame directly, and portable rebounders are generally not anchored at all. The simple anchor system taught herein can be easily and durably mounted.

Accordingly, the specification describes various aspects of the invention according to the following order. First, embodiments of a rebounding frame assembly are shown and described. Second, embodiments of an anchoring system are disclosed. Third, rebounding system embodiments including various interconnections between the rebounding frame assembly and the anchoring systems are discussed. Fourth, methods of assembling and using embodiments of the rebounding and anchoring systems are described.

As used in this specification and the appended claims, the term "rebounder" or "rebound system" is used broadly to encompass an apparatus that springs or bounces and tends to return an object that hits or collides with it. The words "including" and "having," as used in the specification, including the claims, shall have the same meaning as the word "comprising."

As mentioned above, rebound systems have been developed over the years and are currently available. Rebound systems are used both for practice and general play. While there are many different options available, conventional rebound systems have traditionally not provided the combination of strength, adjustability, and ease of use offered by principles of the present invention. The methods and apparatus described herein include various devices that offer many advantages over conventional rebound systems. The particular implementations, however, are exemplary in nature, and not limiting.

Figure 1:
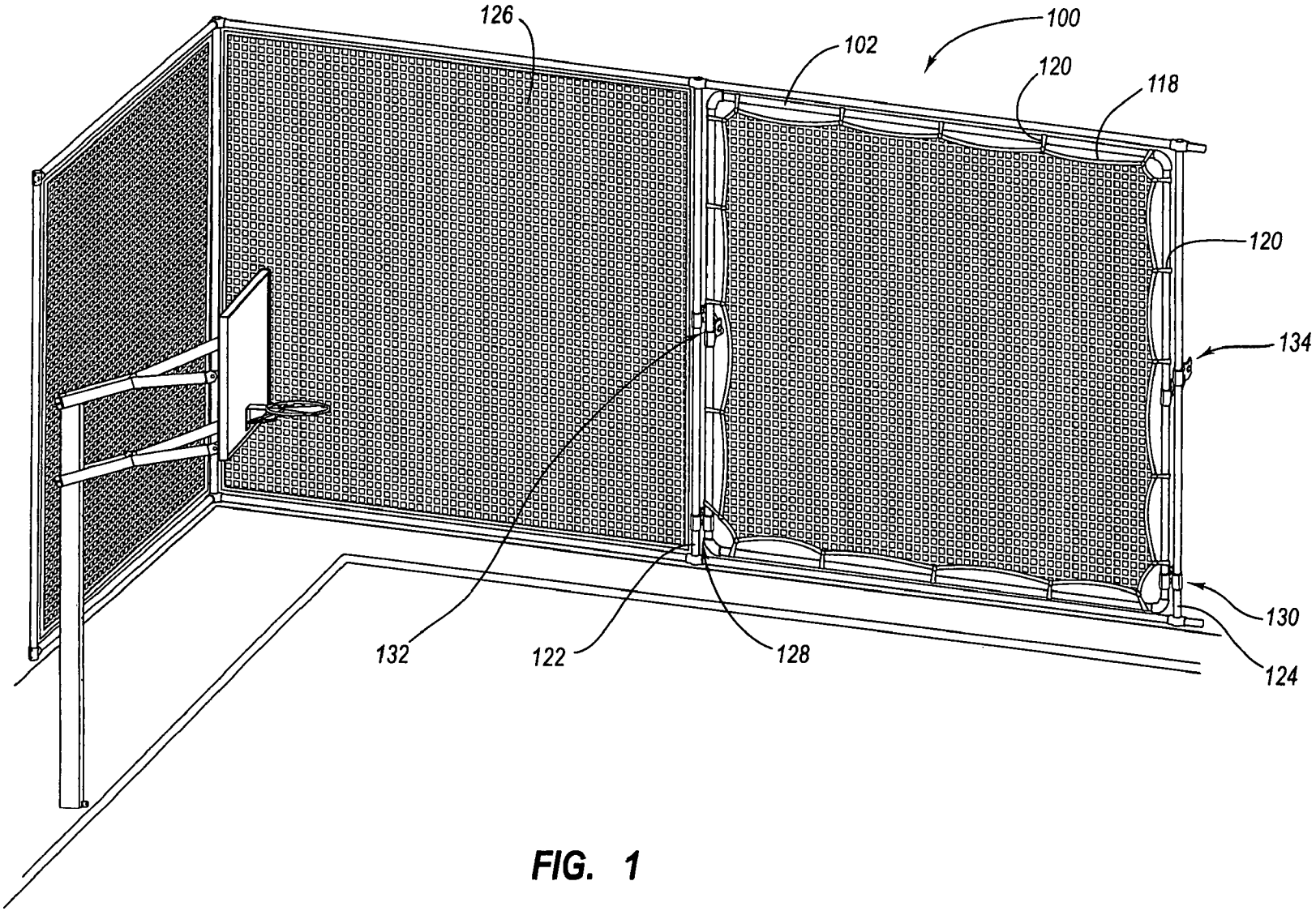
FIG. 1 is a front perspective view of a rebound system according to one embodiment of the present invention.
Figure 2:
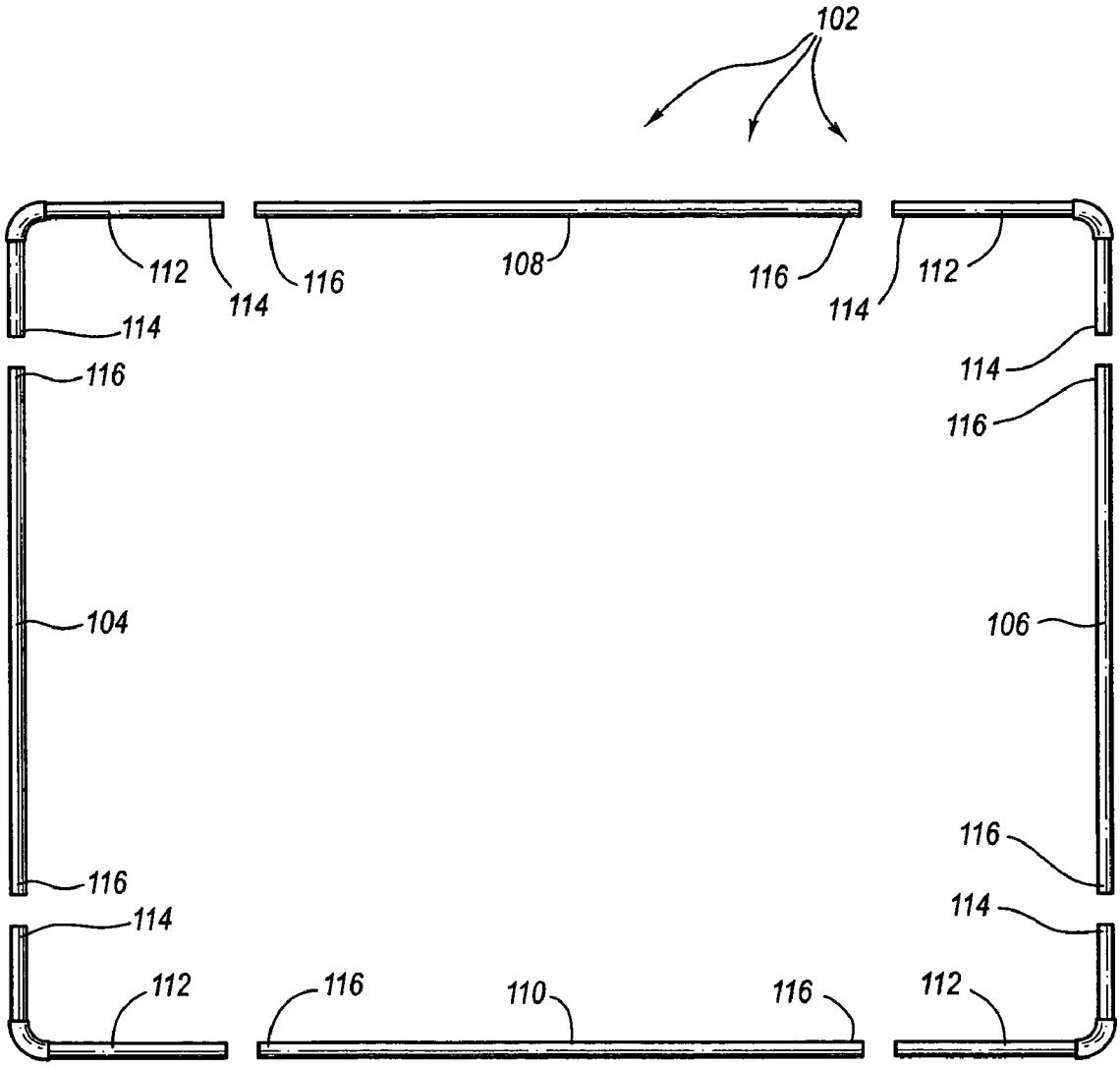
FIG. 2 is an assembly view of a frame assembly for use with the rebound system of FIG. 1 according to one embodiment of the present invention.
Figure 3:
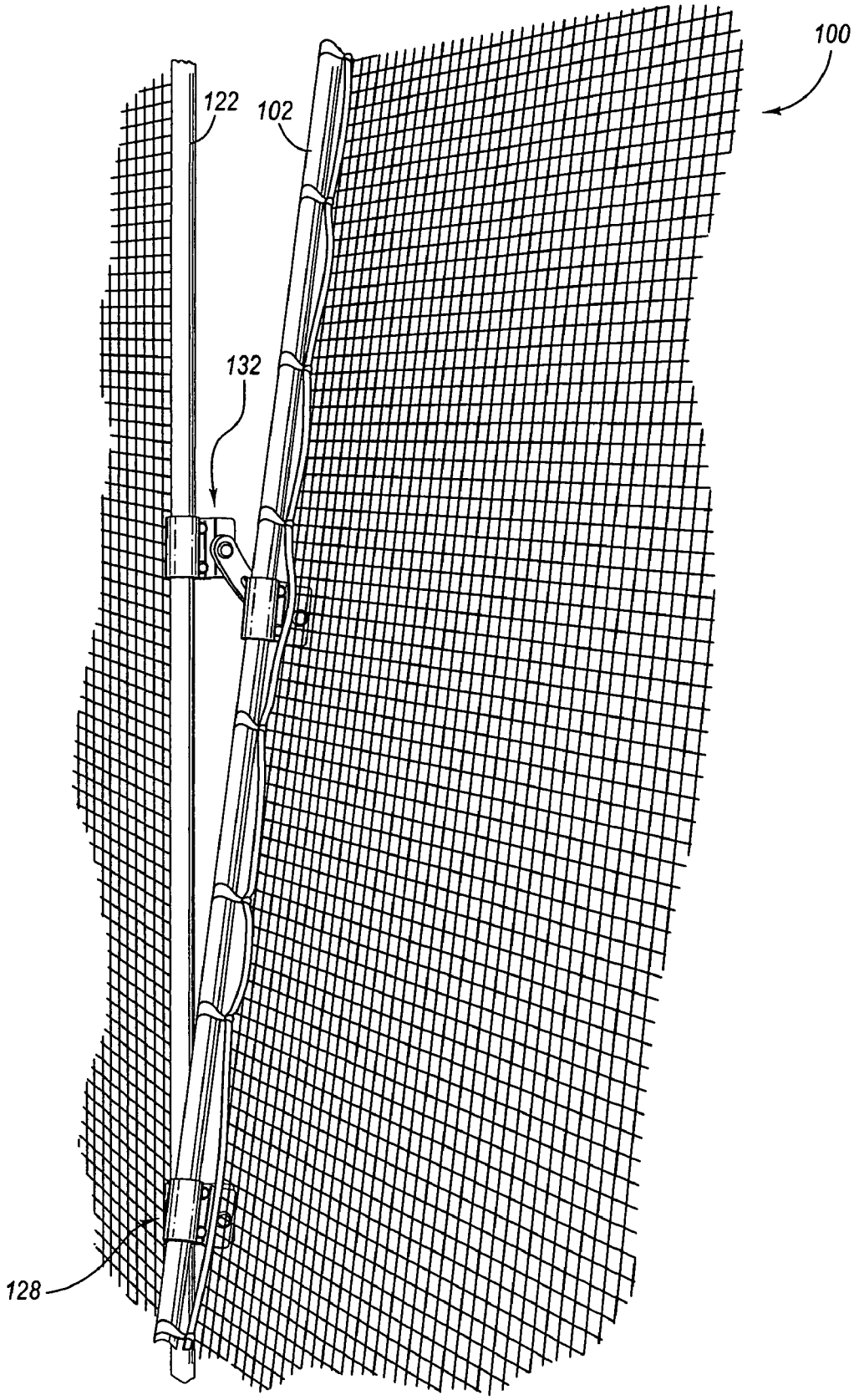
FIG. 3 is a side perspective view of the rebound system of FIG. 1 showing an adjustable angle according to one embodiment of the present invention.

Turning now to the figures, and in particular to FIGS. 1-3, one embodiment of a sporting equipment apparatus, and in particular a rebounder or rebound system 100, is shown according to principles of the present invention. The rebound system 100 comprises a frame assembly 102 made of structural material such as steel. The frame assembly 102 may comprise tubular steel or other components. The frame assembly 102 may be arranged in a generally rectangular or square shape as shown, or it may have any other shape. The frame assembly 102 may be arranged in a generally vertical orientation when in use as shown in FIGS. 1 and 3.

The frame assembly 102 may comprise a single unit or it may include a number of components. For example, as shown in FIG. 2, the frame assembly 102 may comprise several pieces. The frame assembly 102 of FIG. 2 comprises eight components. The eight components include first and second frame verticals 104, 106, first and second frame horizontals 108, 110, and four frame corners 112. Ends 114 of each of the frame corners 112 may be tapered to fit snugly into ends 116 of the frame verticals 104, 106 and the frame horizontals 108, 110. However, the ends 116 of the frame verticals 104, 106 and the frame horizontals 108, 110 may be tapered to fit snugly into ends 114 of the frame corners 112. The frame assembly 102 may be assembled by inserting the four frame corners 112 into associated ends 116 of the frame verticals 104, 106 and the frame horizontals 108, 110 to form the generally rectangular shape shown in FIG. 1. The rectangular shape shown in FIG. 1 may have any dimensions, such as ten feet by fifteen feet, or ten feet by ten feet.

The assembled frame assembly 102 may have a resilient fabric attached to or stretched thereacross. For example, as shown in FIG. 1, a net 118 is stretched across the frame assembly 102 and attached thereto by a plurality of straps 120. The straps 120 may also comprise springs or other fasteners. The net 118 provides a spring or rebound effect as objects impact it. Therefore, user may throw, kick, or hit balls of any kind at the net 118, and the net 118 will rebound the balls back toward the user.

However, in contrast to other rebound systems, the frame assembly is adjustably mounted or attached to an anchor or anchor assembly. The anchor or anchor assembly may be rigidly mounted, for example, to the ground. The anchor assembly may comprise first and second anchor poles 122, 124. The anchor poles 122, 124 may comprise part of a fence 126 (FIG. 1), but this is not necessarily so. The first and second anchor poles 122, 124 may comprise structural materials such as tubular steel. The first and second anchor poles 122, 124 may be buried at least one to three feet, or approximately two feet below grade and cemented in place. The first and second anchor poles 122, 124 may extend above grade approximately one foot to several feet, or about one and a half feet. According to the embodiment of FIG. 1, the first and second anchor poles 122, 124 extend to about ten feet above grade.

The first and second anchor poles 122, 124 support the frame assembly 102. As mentioned above, the frame assembly 102 is adjustably mounted to the anchor, and the anchor of FIGS. 1 and 3 comprises the first and second anchor poles 122, 124. Therefore, according to FIGS. 1 and 3, there is a movable connection between the frame assembly 102 and the first and second anchor poles 122, 124. The movable connection may comprise a first pair of hinges 128, 130 connecting the frame assembly 102 to the anchor poles 122, 124 at a first elevation, and a second pair of sliding hinges 132, 134 connecting the frame assembly 102 to the anchor poles 122, 124 at a second elevation.

Figure 4:
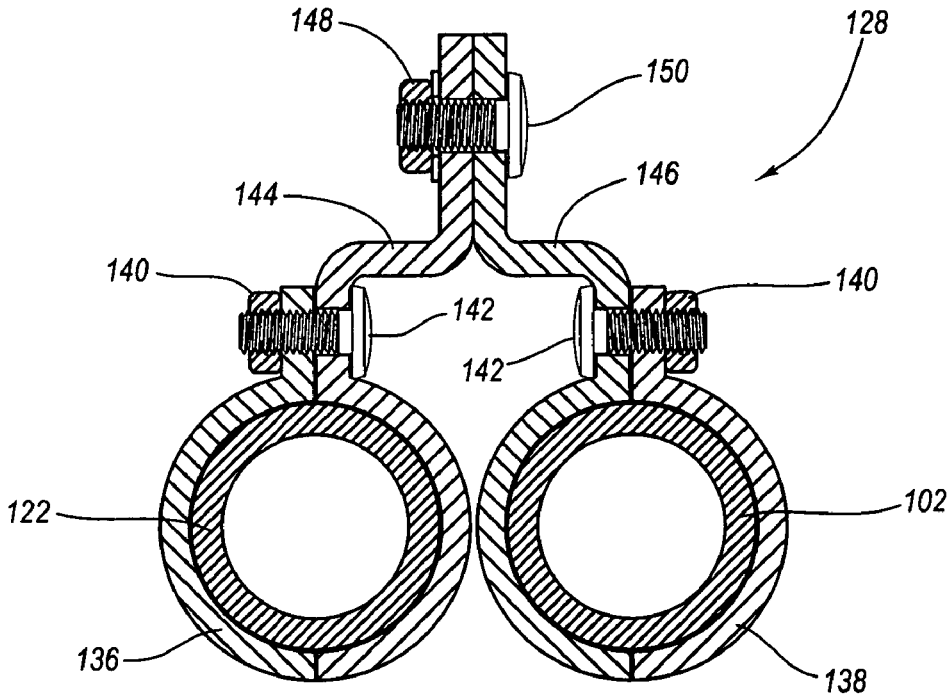
FIG. 4 is a cross sectional view of a hinge assembly of the rebound system shown in FIG. 1 according to one embodiment of the present invention.

The first pair of hinges 128, 130 may comprise pinned hinges connecting a lower portion of the frame assembly 102 to the first and second anchor poles 122, 124, respectively. The first pair of hinges 128, 130 allow pivoting rotation of the frame assembly 102 with respect to the anchor poles 122, 124 and thus the ground. Each of the hinges 128, 130 is substantially the same, and details of one of the hinges 128 are shown in cross-sectional top views in FIG. 4. Referring to FIG. 4, the first hinge 128 comprises a first hinge bracket 136 attached to the first anchor pole 122. The first hinge 128 also comprises a first hinge bracket 138 attached to the frame assembly 102. The first hinges brackets 136, 138 comprise generally cylindrical journals receptive of the first anchor pole 122 and the frame assembly 102, respectively. Fasteners such as first nuts 140 and bolts 142 may facilitate tightening the first hinge brackets 136, 138 around the first anchor pole 122 and the frame assembly 102, respectively. The first hinge brackets 136, 138 are arranged at substantially the same elevation and include mirrored L-bars 144, 146, respectively, that are pivotably pinned together by another nut 148 and bolt 150. Accordingly, the first hinge brackets 136, 138 may rotate related to one another about the bolt 150. The second hinge 130 (FIG. 1) comprises like components, with second hinge brackets attaching to the frame assembly 102 and the second anchor pole 124, respectively.

The second pair of sliding hinges 132, 134 of FIG. 1 connect a mid or upper portion of the frame assembly 102 to the first and second anchor poles 122, 124, respectively. According to some embodiments, the second pair of sliding hinges 132, 134 is arranged approximately four to six feet above the ground, or about sixty-two inches above the ground. The second pair of sliding hinges 132, 134 limits the angle of pivoting rotation allowed by the first pair of hinges 128, 130 and stabilizes the frame assembly 102. The combination of the first pair of hinges 128, 130 and the second pair of sliding hinges 132, 134 facilitates adjustment and locking of the frame assembly at any number of different angles.

Figure 5:
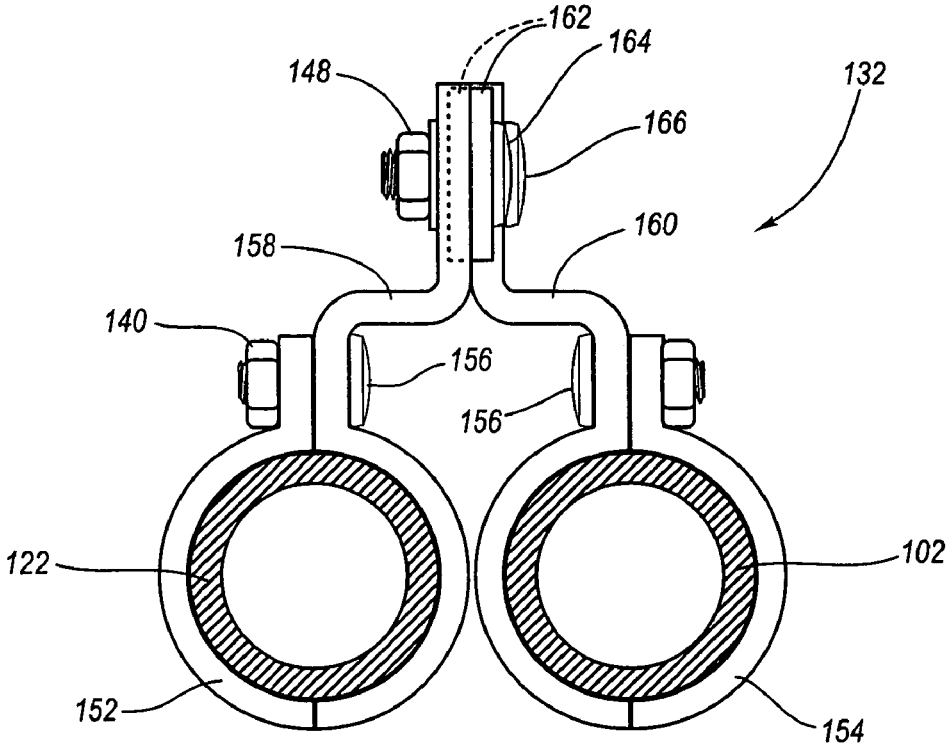
FIG. 5 is a partially cross sectional top view of a sliding hinge assembly of the rebound system shown in FIG. 1 according to one embodiment of the present invention.
Figure 6:
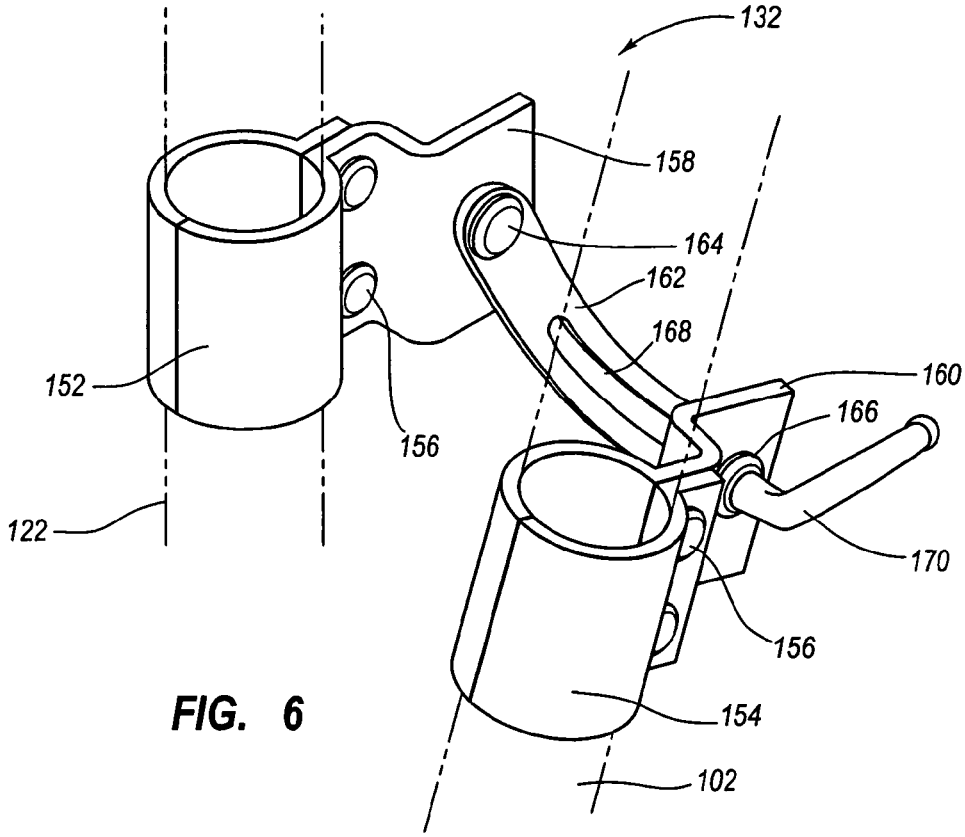
FIG. 6 is a perspective view of the sliding hinge assembly of FIG. 5 in a first position according to one embodiment of the present invention.
Figure 7:
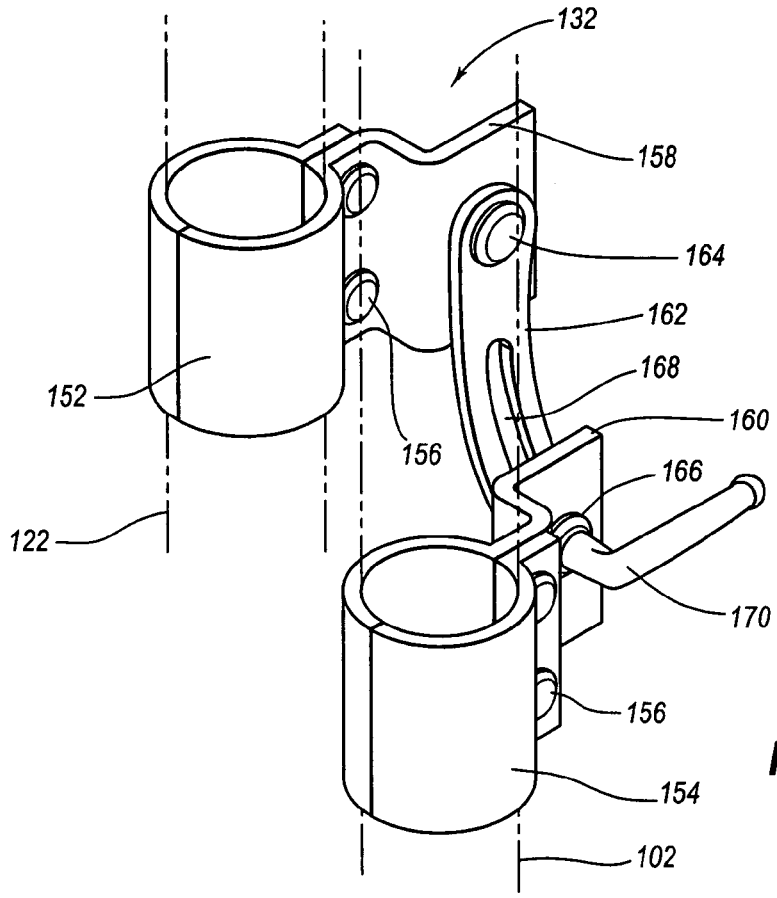
FIG. 7 is a perspective view of the slide hinge assembly of FIG. 6 in a second position according to one embodiment of the present invention.

Each of the sliding hinges 132, 134 is substantially the same, and the details of one of the sliding hinges 132 are shown in a top partial cross sectional view in FIG. 5 and perspective views in FIGS. 6 and 7. Referring to FIGS. 5, 6, and 7, the sliding hinge 132 comprises a third hinge bracket 152 attached to the first anchor pole 122. The sliding hinge 132 also comprises a third hinge bracket 154 attached to the frame assembly 102. The third hinge brackets 152, 154 comprise generally cylindrical journals receptive of the first anchor pole 122 and the frame assembly 102, respectively. Fasteners such as bolts 156 and nuts 140 may facilitate tightening the third hinge brackets 152, 154 around the first anchor pole 122 and the frame assembly 102, respectively. The third hinge brackets 152, 154 are offset from one another at different elevations and include mirrored L-bars 158, 160, respectively that are pivotably pinned to a first slide, for example a curved plate 162, by first and second pins 164, 166.

The curved plate 162 may have a window 168 disposed therein. The window 168 is longitudinal and follows the curve of the curved plate 162. The first pin 164 pivotably attaches to the third hinge bracket 152, which is attached to the anchor pole 122. The second pin 166, however, is rotatably and slidingly attached across the window 168. The curved plate 162 facilitates limited, locking, angular movement of the frame assembly 102. Accordingly, the sliding hinge 132 may rotate and slide, allowing limited rotation of the frame assembly as shown by the transition from a first position to a second position in FIGS. 6 and 7. As shown in FIGS. 6 and 7, as the frame assembly 102 moves from a first angled position of FIG. 6 to a generally vertical position of FIG. 7, the first pin 164 allows the curved plate 162 to rotate. Simultaneous with the rotation about the first pin 164, the second pin 166 rotates and slides up the window 168 toward the first pin 164. Moreover, an adjustment handle 170 may tighten or loosen second pin 164 across the window and lock or release the orientation of the frame assembly 102 in any position. The length and shape of the curved plate 162 and the window 168 are changeable to any convenient configuration to allow any desired range of angular motion for the frame assembly 102. According to the embodiment of FIG. 3, the frame assembly may sweep approximately one to thirty degrees, or about four to ten degrees, or about five degrees.

The second sliding hinge 134 comprises the same or like components as sliding hinge 132, with fourth hinge brackets attaching to the frame assembly 102 and the second anchor pole 124, respectively. Therefore, a player can easily adjust and lock the rebound angle of the frame assembly 102 to suit his or her needs by rotating the frame assembly 102 about the first pair of hinges 128, 130 within the travel limits of the second pair of sliding hinges 132, 134.

Thus, according to principles described herein, the rebound system may be adjusted by pivotably connecting a framed resilient fabric to an anchor, rotating the framed resilient fabric relative to the anchor, and locking the framed resilient fabric relative to the anchor. Rotation of the framed resilient fabric may include sliding a pin attached to the framed resilient fabric or the anchor along a windowed plate interconnecting the framed resilient fabric and the anchor. Locking the orientation of the framed resilient fabric may be accomplished by tightening the pin against or across the windowed plate by turning an adjustment handle. A user may then kick, hit, throw, or otherwise propel a ball or any other object to the framed resilient fabric, and the ball or other object will tend to rebound according to the angle of the framed resilient fabric.

While this invention has been described with reference to certain specific embodiments and examples, it will be recognized by those skilled in the art that many variations are possible without departing from the scope and spirit of this invention. The invention, as defined by the claims, is intended to cover all changes and modifications of the invention which do not depart from the spirit of the invention.

What is claimed is:

1. A ball rebound assembly, comprising:

a frame assembly, the frame assembly comprising:

two frame verticals;

two frame horizontals;

four frame corners;

an anchor assembly comprising two anchor poles;

a resilient net stretched across the frame assembly;

first hinges for adjustable attachment between the frame assembly and the anchor assembly;

second slide hinges for adjustable attachment between the frame assembly and the anchor assembly at a spacing from the first hinges, wherein the first and second hinges determine an angle of the frame assembly and wherein an object that collides with the resilient net rebounds according to the angle of the frame assembly.

2. A ball rebound assembly according to claim 1, further comprising adjustment handles for the slide hinges.

3. A ball rebound assembly according to claim 1 wherein the second slide hinges comprise offset brackets interconnected to one another by pins attached to a windowed plate.

* * * * *